US011536100B2

(12) United States Patent
Krishnasamy et al.

(10) Patent No.: US 11,536,100 B2
(45) Date of Patent: Dec. 27, 2022

(54) TOOL TRAP SYSTEM

(71) Applicant: Cameron International Corporation, Houston, TX (US)

(72) Inventors: Pandeeswaran Krishnasamy, Theni (IN); Prabhu Jagadesan, Coimbatore (IN); Meshach Samuel Raj R, Coimbatore (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 202 days.

(21) Appl. No.: 16/998,090

(22) Filed: Aug. 20, 2020

(65) Prior Publication Data

US 2021/0087893 A1 Mar. 25, 2021

(30) Foreign Application Priority Data

Aug. 20, 2019 (IN) ..... 201941033557

(51) Int. Cl.

| | |
|---|---|
| ***E21B 19/10*** | (2006.01) |
| ***E21B 33/03*** | (2006.01) |
| ***E21B 19/12*** | (2006.01) |
| ***E21B 40/00*** | (2006.01) |

(52) U.S. Cl.

CPC ..... *E21B 19/10* (2013.01)

(58) Field of Classification Search

None

See application file for complete search history.

(56) References Cited

U.S. PATENT DOCUMENTS

| | | | | |
|---|---|---|---|---|
| 2,375,432 | A * | 5/1945 | Miller | E21B 33/061 279/19.5 |
| 3,435,895 | A | 4/1969 | Lee | |
| 4,299,280 | A | 11/1981 | Greer | |
| 4,407,361 | A | 10/1983 | Van Winkle | |
| 4,681,168 | A | 7/1987 | Kisling, III | |
| 4,886,115 | A | 12/1989 | Leggett et al. | |
| 5,203,408 | A * | 4/1993 | Boscher | E21B 19/10 166/70 |
| 6,164,619 | A | 12/2000 | Van Winkle et al. | |
| 6,305,471 | B1 | 10/2001 | Milloy | |

(Continued)

FOREIGN PATENT DOCUMENTS

| | | | |
|---|---|---|---|
| WO | 2005108741 A1 | 11/2005 | |
| WO | WO-2005108741 A1 * | 11/2005 | E21B 33/072 |

(Continued)

OTHER PUBLICATIONS

Search and Examination Report issued in GB patent application No. GB2013017.5 dated May 14, 2021; 8 pages.

*Primary Examiner* — Matthew Troutman
*Assistant Examiner* — Douglas S Wood
(74) *Attorney, Agent, or Firm* — Kelly McKinney

(57) ABSTRACT

A tool trap system that includes a housing. The housing defines a bore. A shaft couples to the housing. A flapper couples to the shaft. The flapper rotates with the shaft between an open position and a closed position to control movement of a wireline tool through the bore. An actuation system couples to the shaft. The actuation system rotates the shaft. The actuation system includes a lever that couples to and rotates the shaft. A cylinder contacts the lever. The cylinder moves axially along a longitudinal axis of the cylinder to rotate the lever.

17 Claims, 6 Drawing Sheets

(56) References Cited

U.S. PATENT DOCUMENTS

| | | | | |
|---|---|---|---|---|
| 6,394,460 | B1 | 5/2002 | Leggett et al. | |
| 6,676,103 | B2 | 1/2004 | Wood | |
| 6,845,958 | B2 | 1/2005 | Wood et al. | |
| 6,877,564 | B2 * | 4/2005 | Layton | F16K 31/54 166/332.8 |
| 7,464,765 | B2 | 12/2008 | Isaacks et al. | |
| 7,510,002 | B2 | 3/2009 | Brown et al. | |
| 7,530,401 | B2 | 5/2009 | Smith et al. | |
| 7,611,120 | B2 | 11/2009 | Wood | |
| 8,443,878 | B2 | 5/2013 | McCollin | |
| 8,567,490 | B2 | 10/2013 | Van Winkle | |
| 8,770,274 | B2 | 7/2014 | Van Winkle | |
| 9,644,447 | B2 | 5/2017 | Wood et al. | |
| 11,125,055 | B2 | 9/2021 | Hernandez | |
| 11,162,318 | B2 * | 11/2021 | McDaniel | E21B 33/072 |
| 2015/0114618 | A1 * | 4/2015 | Torrent | E21B 19/12 166/75.11 |
| 2019/0055795 | A1 * | 2/2019 | Park | E21B 19/008 |
| 2019/0383113 | A1 * | 12/2019 | McDaniel | E21B 33/03 |

FOREIGN PATENT DOCUMENTS

| | | | | |
|---|---|---|---|---|
| WO | 2017019547 | A1 | 2/2017 | |
| WO | WO-2017019547 | A1 * | 2/2017 | E21B 19/24 |
| WO | 2018191674 | A1 | 10/2018 | |
| WO | 2018229457 | A1 | 12/2018 | |

* cited by examiner

TOOL TRAP SYSTEM

BACKGROUND

This application claims priority to and the benefit of India Application No. 201941033557, filed on Aug. 20, 2019, the entirety of which is incorporated herein by reference.

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of the desired resource. Such systems generally include a wellhead assembly through which the resource is extracted. These wellhead assemblies may include a wide variety of components, such as various casings, valves, fluid conduits, that control drilling or extraction operations.

After drilling the well, various downhole operations may be performed by lowering equipment into the well. These operations may include well intervention operations, measurement operations (e.g., logging), pipe recovery, perforation operations, among others. The tools that enable these kinds of downhole operations are lowered into the well with a wireline and/or slackline. Unfortunately, closing one or more valves on the wellhead may sever the wireline and/or slackline that suspends the tool.

SUMMARY

Certain aspects of some embodiments disclosed herein are set forth below. It should be understood that these aspects are presented merely to provide the reader with a brief summary of certain forms the disclosure might take and that these aspects are not intended to limit the scope of the disclosure. Indeed, the disclosure may encompass a variety of aspects that may not be set forth below.

In one embodiment, a tool trap system includes a housing. The housing defines a bore. A shaft couples to the housing. A flapper couples to the shaft. The flapper rotates with the shaft between an open position and a closed position to control movement of a wireline tool through the bore. An actuation system couples to the shaft. The actuation system rotates the shaft. The actuation system includes a lever that couples to and rotates the shaft. A cylinder contacts the lever. The cylinder moves axially along a longitudinal axis of the cylinder to rotate the lever.

In another embodiment, a tool trap system includes a shaft that rotates in a housing. A flapper couples to the shaft. The flapper rotates with the shaft between an open position and a closed position to control movement of the wireline tool through the housing. An actuation system couples to and rotates the shaft. The actuation system includes a lever that couples to the shaft. The lever rotates the shaft. A cylinder couples to the lever. The cylinder moves axially along a longitudinal axis of the cylinder to rotate the lever. A first actuator couples to the cylinder and axially moves the cylinder in the first direction.

In another embodiment, a tool trap system. The tool trap includes a first shaft and a second shaft that rotate in a housing. A first flapper couples to the first shaft. A second flapper couples to the second shaft. The first flapper and the second flapper rotate respectively with the first shaft and the second shaft between an open position and a closed position to control the movement of a wireline tool through the housing. An actuation system couples to the first shaft and the second shaft. The actuation system rotates the first shaft and the second shaft. The actuation system includes a first lever coupled to the first shaft. The first lever rotates the first shaft. A second lever couples to the second shaft. The second lever rotates the second shaft. A cylinder couples to the first lever and to the second lever. The cylinder is configured to move axially along a longitudinal axis of the cylinder to rotate the first lever and the second lever. A first actuator couples to the cylinder and axially moves the cylinder in the first direction.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The description below includes a tool trap system that blocks unintended insertion of tools into a well. The tool trap includes one or more flappers (e.g., projection, plate) placed within a bore. The flappers open and close to enable tools (e.g., perforation tool, logging tool) to be inserted into the well as well as to block the unintended insertion of tools into the well.

Figure 1:
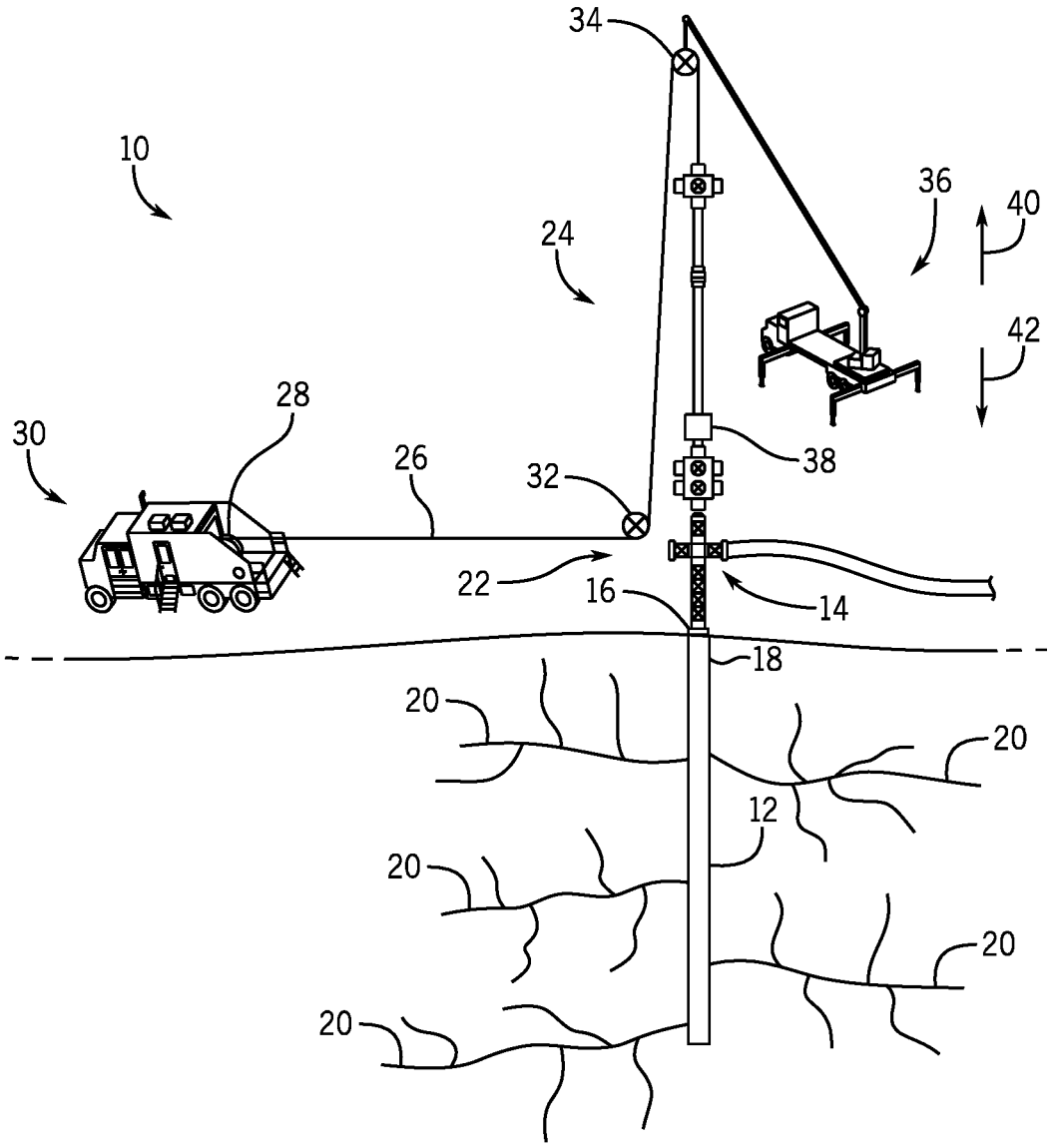
FIG. 1 is an illustration of a hydraulic fracturing system with a tool trap system, in accordance with an embodiment of the present disclosure.

FIG. 1 is an illustration of a hydrocarbon extraction system 10 capable of hydraulically fracturing a well 12 to extract various minerals and natural resources (e.g., oil and/or natural gas). The hydrocarbon extraction system 10 includes a frac tree 14 coupled to the well 12 via a wellhead hub 16. The wellhead hub 16 includes a large diameter hub disposed at the termination of a well bore 18 and is designed to connect the frac tree 14 to the well 12. The frac tree 14 may include multiple components that control fluid flow into and out of the well 12. For example, the frac tree 14 may route oil and natural gas from the well 12, regulate pressure in the well 12, and inject chemicals into the well 12.

The well 12 may have multiple formations at different locations. In order to access each of these formations (e.g., hydraulically fracture), the hydrocarbon extraction system may use a downhole tool coupled to a tubing (e.g., coiled tubing, conveyance tubing). In operation, the tubing pushes and pulls the downhole tool through the well 12 to align the downhole tool with each of the formations. Once the tool is in position, the tool prepares the formation to be hydraulically fractured by plugging the well 12 and boring through the casing. For example, the tubing may carry a pressurized cutting fluid that exits the downhole tool through cutting ports. After boring through the casing, frac fluid (e.g., a combination of water, proppant, and chemicals) may be pumped into the well 12 at high pressures.

As the frac fluid pressurizes the well 12, the frac fluid fractures the formations releasing oil and/or natural gas by propagating and increasing the size of cracks 20. Once the formation is hydraulically fractured the well 12 is depressurized by reducing the pressure of the frac fluid and/or releasing frac fluid through valves 22 (e.g., wing valves). In operation, the valves 22 control the flow of pressurized fluid into and out of the well 12, as well as the insertion and removal of tools.

To facilitate insertion of tools into the well 12, a lubricator 24 couples to the fracturing tree 14. The lubricator 24 is an assembly of conduits coupled together to form a passage (e.g., axial passage). Various tools may be placed within this passage for insertion into and retrieval from the well 12. These tools may include logging tools, perforating guns, plugging tools, among others. For example, a perforating gun may be placed in the lubricator 24 for insertion in the well 12. After performing downhole operations (e.g., perforating the casing), the tool is withdrawn back into the lubricator 24 with a wireline 26.

The wireline 26 extends and retracts in response to rotation of a reel 28. In operation, the reel 28 rotates to wind and unwind the wireline 26. In some embodiments, the wireline 26 and reel 28 may be carried on a wireline truck 30 along with a motor that controls rotation of the reel 28. In order to position and orient the wireline 26, the wireline 26 may pass through one or more pulley's 32, 34. As illustrated, the pulley 34 is suspended with a crane 36 above the lubricator 24. In this position, the wireline 26 is able enter and exit the lubricator 24 in a vertical orientation, which facilitates insertion and retraction of tools while also reducing friction and wear on the wireline 26.

In order to block the unintended insertion of tools into the well 12, the hydrocarbon extraction system includes a tool trap system 38. The tool trap system 38 selectively obstructs a bore in the lubricator 24 to block the movement of tools into the well 12. For example, after performing downhole operations (e.g., perforating the casing), the tool is withdrawn back into the lubricator 24 and through the tool trap system 38. The tool trap system 38 enables the tool to travel in direction 40, but blocks movement in direction 42 unless specifically opened. In this way, the tool trap system 38 enables the retraction of tools from the well 12 while also blocking the unintentional insertion of tools into the well 12.

Figure 2:
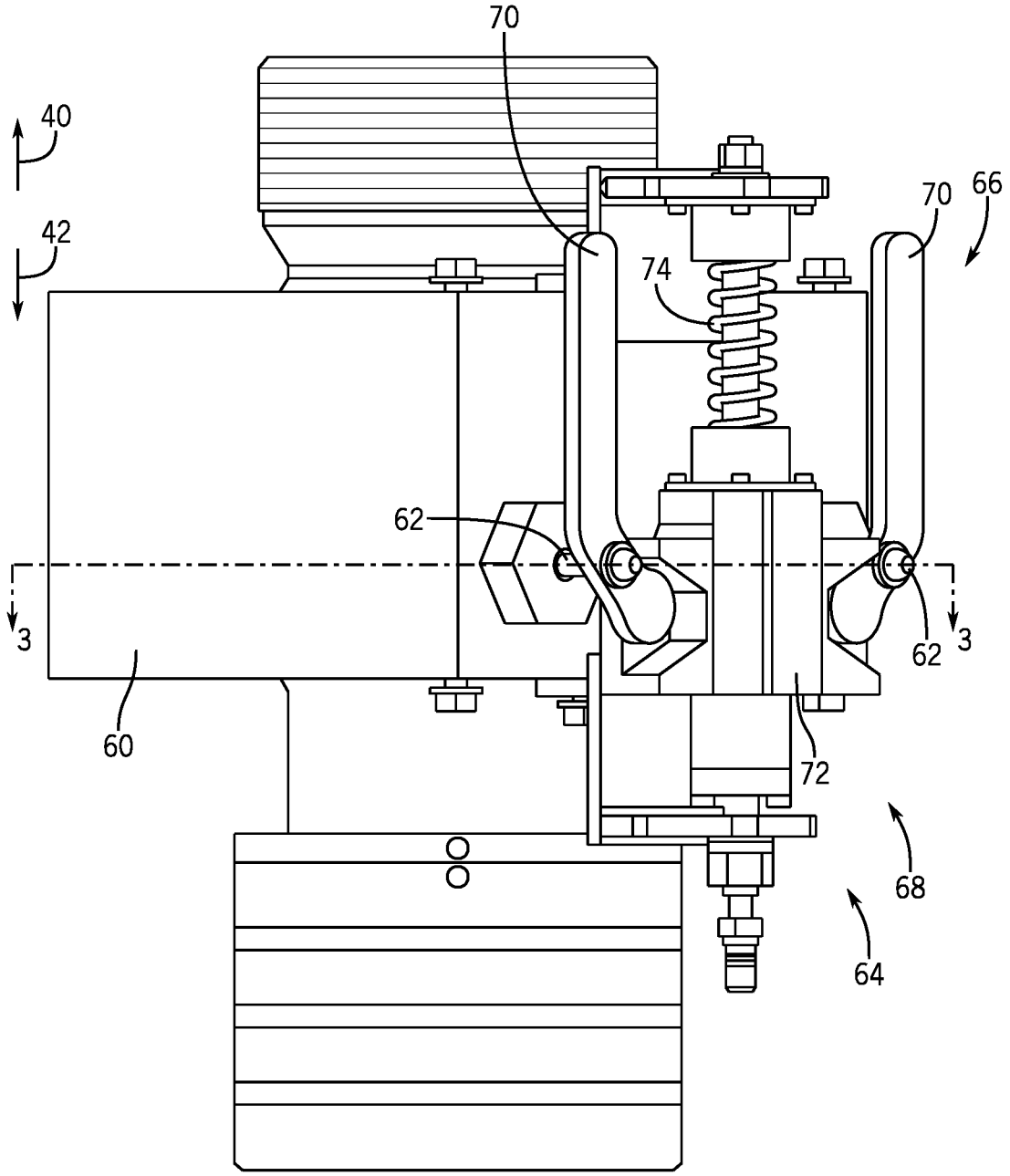
FIG. 2 is a perspective side view of a tool trap system, in accordance with an embodiment of the present disclosure.

FIG. 2 is a perspective side view of the tool trap system 38. The tool trap system 38 includes a housing or body 60 that receives flappers (e.g., plates) that selectively obstruct a bore through the housing 60. The flappers couple to shafts 62 that enable the flappers to rotate between open and closed positions in the housing 60. In the closed position, the flappers block movement of tools in direction 42 through the tool trap system 38. An actuation system 64 couples to the shafts 62. In operation, the actuation system 64 rotates the shafts 62. As will be explained below, the actuation system 64 may include a manual actuator 66 as well as a powered actuator 68. The manual actuator 66 may include one or more levers 70. The levers 70 couple to the shafts 62 enabling an operator to manually rotate the shafts 62 which rotate the flappers to the open position inside the housing 60. The powered actuator 68 similarly rotates the shafts 62 in order to open the tool trap system 38. The powered actuator 68 may be a hydraulic actuator, pneumatic actuator, electric actuator, or a combination thereof. The powered actuator 68 is configured to drive the cylinder 72 in direction 40. As the cylinder 72 moves in direction 40, the cylinder 72 contacts and rotates the levers 70. As the levers 70 rotate, they rotate the shafts 62 opening the tool trap system 38. In order to bias the tool trap system 38 to a closed position, the actuator system 64 includes a spring 74. The spring 74 biases the cylinder 72 in direction 42, which rotates the levers 70 and the shafts 62 in the opposite direction. As the shafts 62 rotate, the flappers transition to the closed position.

Figure 3:
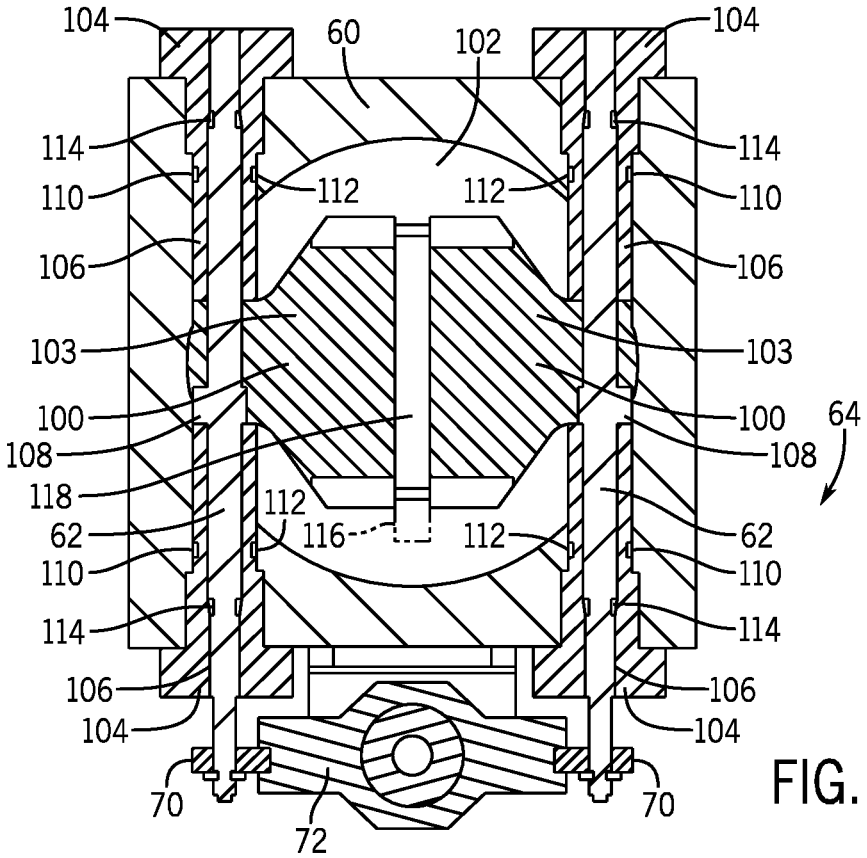
FIG. 3 is a partial cross-sectional top view of the tool trap system in a closed position along line 3-3 of FIG. 2, in accordance with an embodiment of the present disclosure.

FIG. 3 is a partial cross-sectional view of the tool trap system 38 in a closed position along line 3-3 of FIG. 2. As illustrated, the flappers 100 (e.g. plates) are in a closed position to block tools from being lowered into the well 12. In the closed position, the flappers 100 may be supported by a flange, protrusion, and/or another portion 102 of the housing 60. The support provided by the flange 102 may enable tools to rest on an upper surface 103 of the flappers 100 as well as block rotation of the flanges 102. In other words, the flange 102 may block rotation of the flappers 100 in response to a force contacting the upper surface 103 of the flappers 100.

The flappers 100 couple to shafts 62 that extend through the housing 60. The shafts 62 are retained in the housing 60 with shaft retainers 104. The shaft retainers 104 may threadingly couple to the housing 60 and define apertures 106 that receive the shafts 62. The shaft retainers 104 contact the flappers 100 and/or a protrusion 108 on the shafts 62 to block the shafts 62 from sliding through the shaft retainers 104. In some embodiments, seals 110 (e.g., circumferential seals) may be used to form a seal between the shaft retainers 104 and the housing 60. The seals 110 may rest within grooves 112 (e.g., circumferential grooves) on the shaft retainers 104. In some embodiments, the grooves 112 may be formed into the housing 60. Likewise, seals 114 (e.g., circumferential seals) may be used to form seals between the shafts 62 and the shaft retainers 104. In the closed position, the flappers 100 define a gap 116. The gap 116 enables a wireline to extend through the tool trap system 38 and couple to a tool in the well. In this way, a tool may be raised and lowered through the bore 118 of the tool trap system 38.

Figure 4:
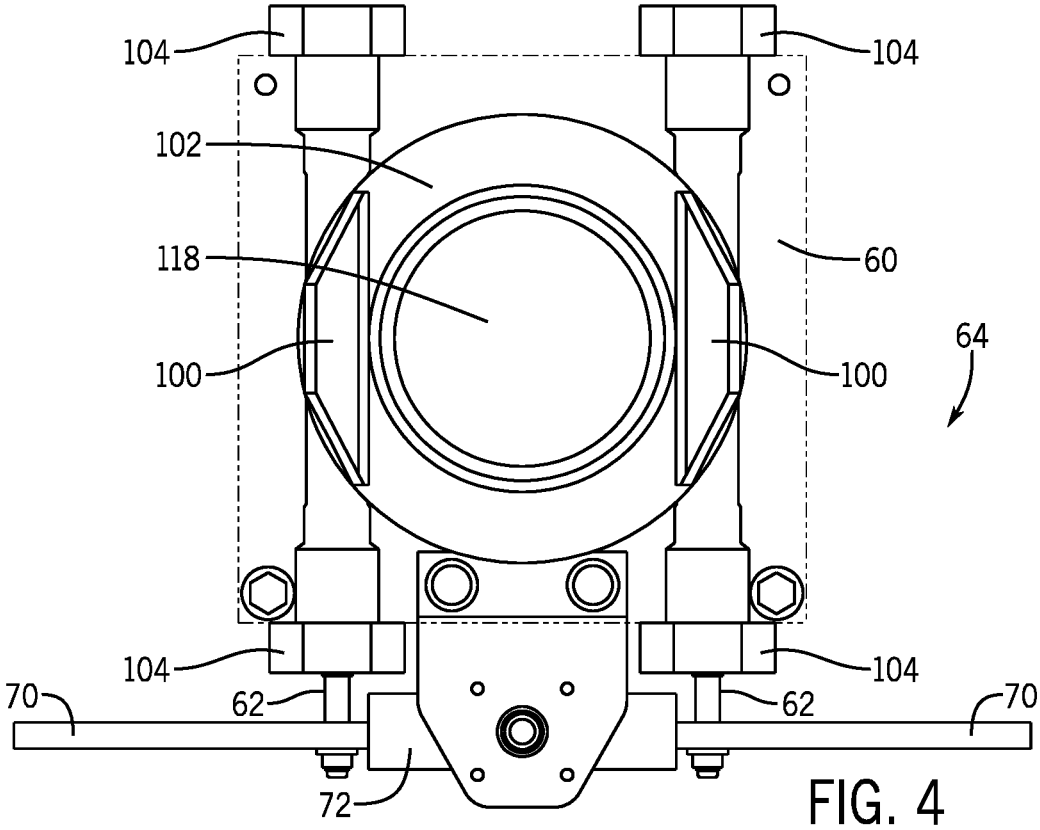
FIG. 4 is a top view of the tool trap system in an open position, in accordance with an embodiment of the present disclosure.

FIG. 4 is a partial cross-sectional view of the tool trap system 38 in an open position along line 3-3 of FIG. 2. As illustrated, the flappers 100 have been rotated from the closed position illustrated in FIG. 3 to the open position illustrated in FIG. 4. In the open position, a tool may be lowered through the bore 118 of the housing 60 and into a well. The flappers 100 may be rotated to the open position through contact with a tool exiting the well or by rotation of the shafts 62 with the actuation system 64.

Figure 5:
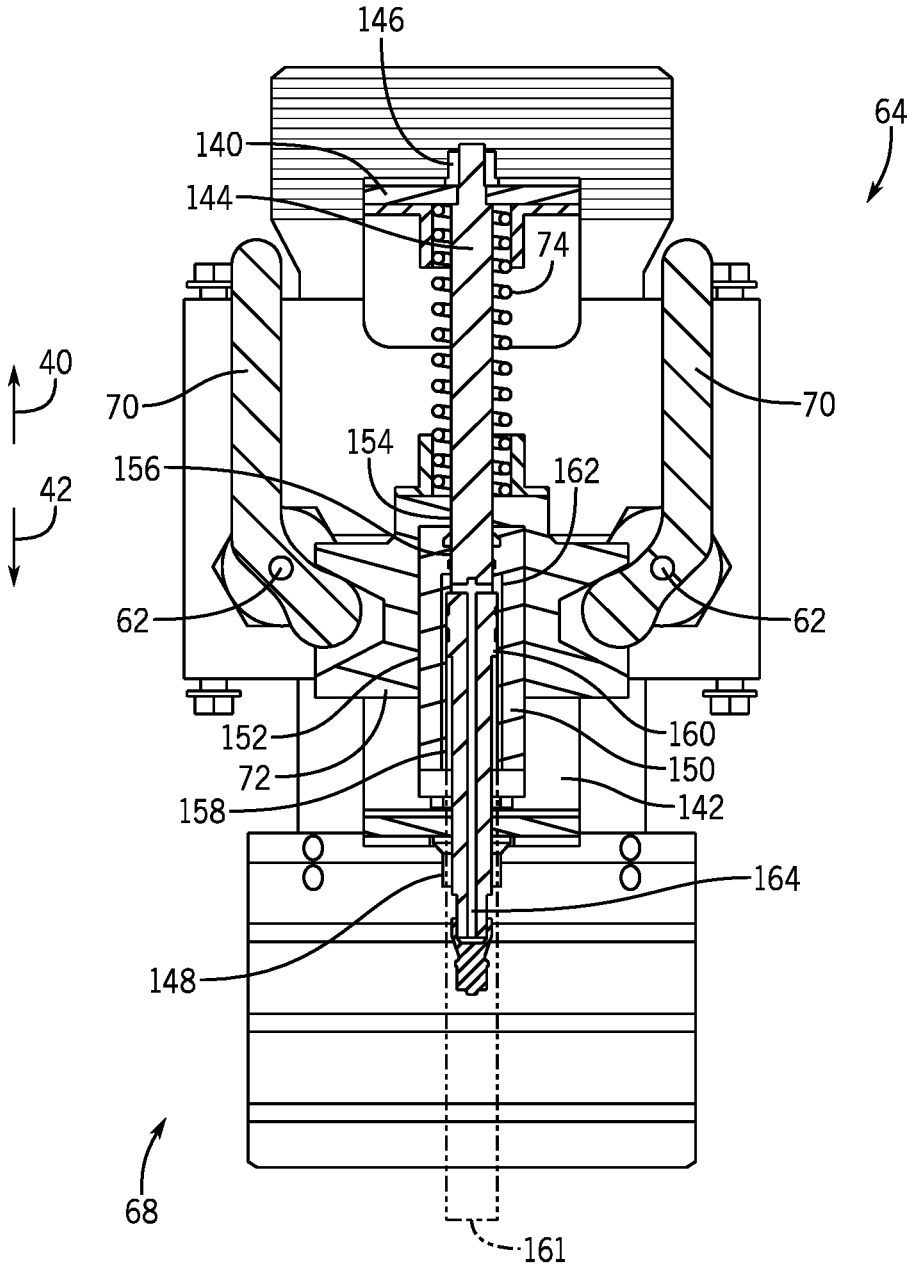
FIG. 5 is a partial cross-sectional side view of the tool trap system of FIG. 2 in an unactuated state, in accordance with an embodiment of the present disclosure.

FIG. 5 is a side view of the tool trap system 38 of FIG. 2 with the actuation system 64 in an unactuated state. The actuation system 64 includes both a manual actuator 66 and a powered actuator 68 that enable the opening and closing of the tool trap system 38. As explained above, the flappers 100 couple to the shafts 62 which enable the flappers 100 to rotate between open and closed positions in the housing 60. In order to open and close the flappers 100, the actuation system 64 couples to the shafts 62 with the levers 70. The levers 70 form part of both the manual actuator 66 and the power actuator 68. As illustrated, the levers 70 couple to the shafts 62 enabling an operator to grip and rotate levers 70, which in turn rotate the shafts 62. As the shafts 62 rotate, the flappers 100 transition from the closed position to the open position. In this way, the manual actuator 66 may open the tool trap system 38 and enable tools to pass through.

The powered actuator 68 similarly rotates the shafts 62 in order to open the tool trap system 38. The powered actuator 68 couples to the housing 60 with a first bracket 140 and a second bracket 142. These brackets 140, 142 may be bolted, welded, or integrally formed with the housing 60. The brackets 140, 142 couple to the piston rod 144. In some embodiments, the piston rod 144 extends through the brackets 140, 142 (e.g., extend through apertures in the brackets 140, 142). The piston rod 144 couples to the brackets 140, 142 with respective fasteners 146 and 148 (e.g., threaded fasteners, nuts). The fasteners 146, 148 and/or the brackets 140, 142 block movement of the piston rod 144 during operation of the powered actuator 68. In other words, the piston rod 144 remains in a fixed position during operation of the actuation system 64.

The piston rod 144 extends through the cylinder 72 (e.g., cam cylinder) and through a second cylinder or hydraulic cylinder 150. The cylinder 72 defines a cavity 152 (e.g., counterbore) that receives the hydraulic cylinder 150 and an aperture 154 in fluid communication with the counterbore 152. The counterbore 152 and aperture 154 enable the piston rod 144 to extend through the cylinder 72. The hydraulic cylinder 150 similarly defines an aperture 156 in fluid communication with a counterbore 158 that enables the piston rod 144 to extend through the hydraulic cylinder 150. As illustrated, the counterbore 158 of the hydraulic cylinder 150 receives a portion 160 (e.g., enlarged cylindrical portion) of the piston rod 144. The portion 160 defines a diameter 161 that equals or is substantially equal to the diameter of the counterbore 158. In this way, the hydraulic cylinder 150 and the portion 160 of the piston rod 144 form a chamber 162 that receives a fluid (e.g., liquid, gas, or a combination thereof). The fluid flows into the chamber 162 through a passage 164 in the piston rod 144. As fluid flows into the chamber 162, the pressure of the fluid builds and drives the hydraulic cylinder 150 in direction 40. As the hydraulic cylinder 150 moves in direction 40, the hydraulic cylinder 150 drives the cylinder 72 in direction 40.

Figure 6:
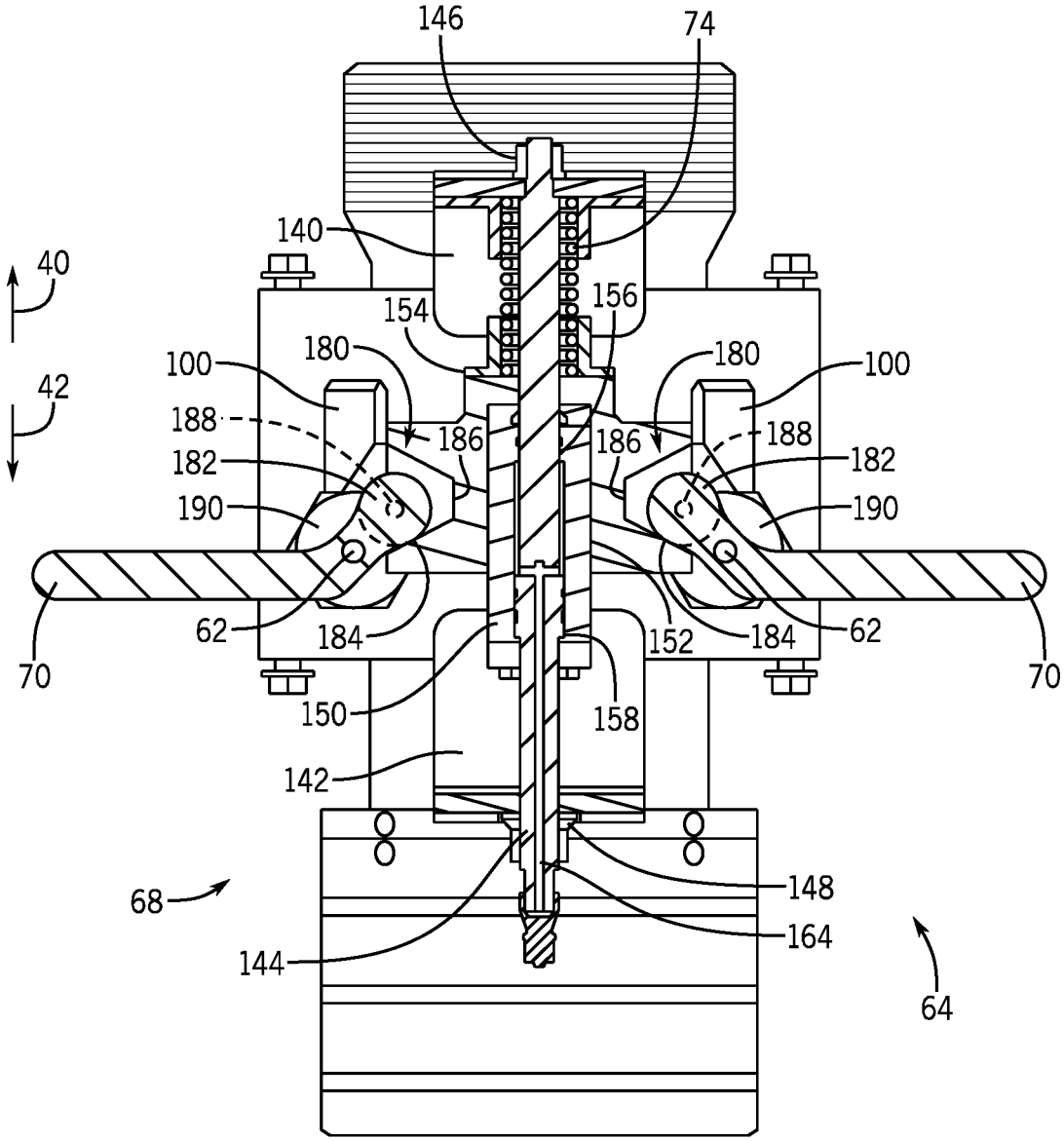
FIG. 6 is a partial cross-sectional side view of a tool trap system of FIG. 2 in an actuated state, in accordance with an embodiment of the present disclosure.

FIG. 6 is a side view of the tool trap system 38 of FIG. 2 in an actuated state. In the actuated state, the flappers 100 are open enabling a tool to be inserted into the well 12. As explained above, pressurized fluid flow into the chamber 162 formed by the hydraulic cylinder 150 and the portion 160 of the piston rod 144 drives the hydraulic cylinder 150 and cylinder 72 in direction 40. Movement of the cylinder 72 in direction 40 compresses the spring 74 (e.g., mechanical spring, air spring) that biases the cylinder 72 in direction 42. In addition to compressing the spring 74, movement of the cylinder 72 rotates the levers 70. As illustrated, the cylinder 72 defines recesses 180 that receive ends 182 of the levers 70. The ends 182 define cam surfaces 184 (e.g., lobes) that contact surfaces 186 of the cylinder 72 that define the recesses 180. In operation, as the cylinder 72 moves in direction 40, the surfaces 186 of the cylinder 72 contact the cam surfaces 184 of the levers 70. The contact between these surfaces 184 and 186 rotates the levers 70. The levers 70 in turn rotate the shafts 62 and open the flappers 100. In some embodiments, cam rollers 188 may be used to engage the contact surfaces 186 of the cylinder 72. As the cam rollers 188 engage the cylinder 72 they transfer the movement of the cylinder 72 to the levers 70 which rotate the shafts 62.

After a tool passes through the tool trap system 38 the pressure in the chamber 162 is released. Fluid in the chamber 162 is then able to flow out of the chamber 162 and through the piston rod 144. The release of pressure enables the spring 74 to bias the cylinder 72 in direction 42. As the cylinder 72 moves in direction 42, the surfaces 186 that define the recesses 180 contact the cam surfaces 184 of the levers 70 rotating them in the opposite direction. As the levers 70 rotate in the opposite direction, the lever 70 rotate the shafts 62 and closes the flappers 100. In some embodiments, the tool trap system 38 may include torsion springs 190 that couple to the shafts 62. In operation, the torsion springs 190 bias the flappers 100 to a closed position.

It should be understood that when manually actuating the tool trap system 38 with the levers 70, the cylinder 72 is driven in direction 40 and the hydraulic cylinder 150 remains in place. In other words, the cylinder 72 moves with respect to the hydraulic cylinder 150 in response to manual actuation of the tool trap system 38.

Figure 7:
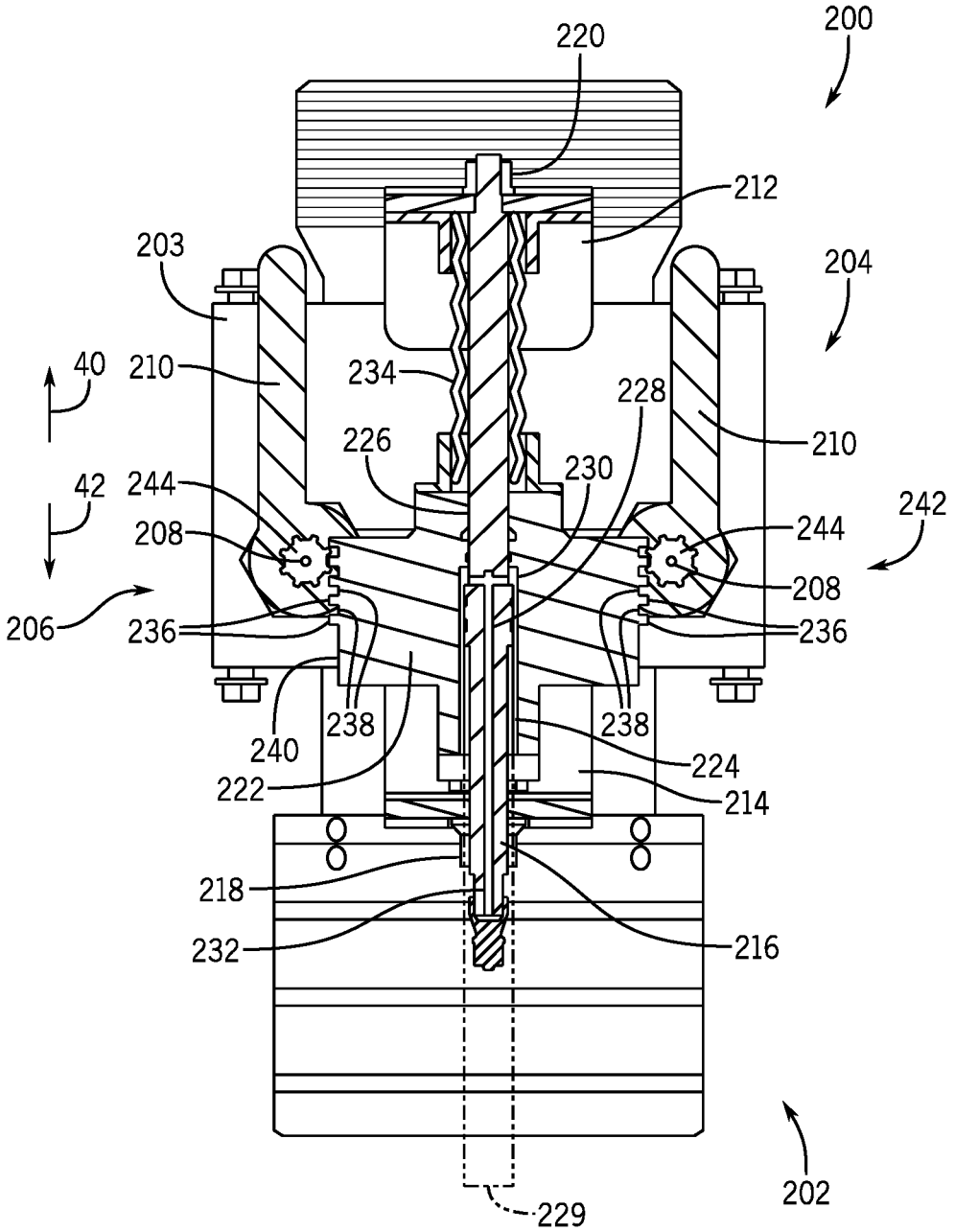
FIG. 7 is a side view of a tool trap system in an unactuated state, in accordance with an embodiment of the present disclosure.

FIG. 7 is a side view of a tool trap system 200 in an unactuated state. The tool trap system 200 includes an actuation system 202 that opens and closes flappers (e.g., plates) inside the housing 203. The actuation system 202 includes both a manual actuator 204 and a powered actuator 206 that enable the opening and closing of the tool trap system 200 (i.e., opening and closing the flappers). The flappers couple to shafts 208 which rotate the flappers between open and closed positions. The actuation system 202 couples to the shafts 208 with levers 210. The levers 210 form part of both the manual actuator 204 and the powered actuator 206. As illustrated, the levers 210 couple to the shafts 208 enabling an operator to grip and rotate levers 210, which in turn rotate the shafts 208.

The powered actuator 206 similarly rotates the shafts 208 in order to open the tool trap system 200. The powered actuator 206 couples to the housing 203 with a first bracket 212 and a second bracket 214. These brackets 212, 214 may be bolted, welded, or integrally formed with the housing 203. The brackets 212, 214 receive a piston rod 216. In some embodiments, the piston rod 216 extends through the brackets 212, 214. The piston rod 216 couples to the brackets 212, 214 with respective fasteners 218 and 220 (e.g., threaded fasteners, nuts). The fasteners 218, 220 and/or the brackets 212, 214 block movement of the piston rod 216 during operation of the powered actuator 206.

The piston rod 216 extends through a cylinder 222. The cylinder 222 defines a counterbore 224. The cylinder 222 defines an aperture 226 in fluid communication with the counterbore 224. The counterbore 224 and aperture 226 enable the piston rod 216 to extend through the cylinder 222. As illustrated, the counterbore 224 of the cylinder 222 receives a portion 228 (e.g., enlarged cylindrical portion) of the piston rod 216. The portion 228 defines a diameter 229 that equals or is substantially equal to the counterbore 224. In this way, the cylinder 222 and the portion 228 of the piston rod 216 form a chamber 230 that receives a fluid (e.g., liquid, gas, or a combination thereof). The fluid flows into the chamber 230 through a passage 232 in the piston rod 216. As fluid flows into the chamber 230, the pressure of the fluid builds and drives the cylinder 222 in direction 40.

As the cylinder 222 moves in direction 40, the cylinder 222 compresses an air spring 234 that biases the cylinder 222 in direction 42. In addition to compressing the air spring 234, movement of the cylinder 222 rotates the levers 210. As illustrated, the cylinder 222 defines series of protrusions 236 and recesses 238 on an outer circumferential surface 240. These protrusions 236 and 238 form a rack(s) 242 that engages gears 244 on or coupled to the levers 210. In some embodiments, racks may be separately coupled to the cylinder 222. In operation, as the cylinder 222 moves in direction 40, the racks 242 contact the gears 244 of the levers 210. The contact between the racks 242 and the gears 244 rotates the levers 210. The levers 210 in turn rotate the shafts 208 and open the flappers.

After a tool passes through the tool trap system 38 the pressure in the chamber 230 is released. Fluid in the chamber 230 is then able to flow out of the chamber 230 and through the piston rod 216. The release of pressure enables the air spring 234 to bias the cylinder 222 in direction 42. As the cylinder 222 moves in direction 42, the racks 242 rotate the gears 244 which in turn rotate the levers 210. As the levers 210 rotate, the flappers rotate to a closed position.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The invention claimed is:

1. A tool trap system, comprising:
- a housing, the housing defining a bore through the housing;
- a shaft coupled to the housing;
- a flapper coupled to the shaft, wherein the flapper is configured to rotate with the shaft between an open position and a closed position to control movement of a wireline tool through the bore;
- an actuation system coupled to the shaft, the actuation system configured to rotate the shaft, the actuation system comprising:
- a lever coupled to the shaft, wherein the lever is configured to rotate the shaft;
- a cylinder configured to contact the lever, wherein the cylinder is configured to move axially along a longitudinal axis of the cylinder to rotate the lever; and
- a piston rod configured to extend through the cylinder, wherein the piston rod is configured to remain stationary as the cylinder moves axially.

2. The tool trap system of claim 1, wherein the cylinder defines a surface configured to contact and rotate the lever as the cylinder moves axially.

3. The tool trap system of claim 2, wherein the cylinder defines a recess that receives a first end of the lever, wherein the surface defines a portion of the recess.

4. The tool trap system of claim 2, wherein the lever comprises a cam roller configured to contact the surface.

5. The tool trap system of claim 1, comprising a first bracket and a second bracket, wherein the first bracket and the second bracket are configured to respectively couple to a first end and a second end of the piston rod.

6. The tool trap system of claim 1, further comprising a hydraulic cylinder configured to receive the piston rod, wherein a fluid pumped into the hydraulic cylinder is configured to axially move the hydraulic cylinder.

7. The tool trap system of claim 1, comprising a spring configured to contact the cylinder to bias the flapper to the closed position.

8. The tool trap system of claim 7, wherein the spring is configured to surround a piston rod.

9. The tool trap system of claim 1, comprising a spring coupled to the shaft, wherein the spring is configured to bias the flapper to the closed position.

10. A tool trap system, comprising:
- a shaft configured to rotate in a housing;
- a flapper coupled to the shaft, wherein the flapper is configured to rotate with the shaft between an open position and a closed position to control movement of a wireline tool through the housing;

an actuation system coupled to the shaft, the actuation system configured to rotate the shaft, the actuation system comprising:

a lever coupled to the shaft, wherein the lever is configured to rotate the shaft;

a cylinder configured to couple to the lever, wherein the cylinder is configured to move axially along a longitudinal axis of the cylinder to rotate the lever;

a first actuator coupled to the cylinder and configured to axially move the cylinder in a first direction; and a gear coupled to the lever.

11. The tool trap system of claim 10, wherein the first actuator comprises an electric actuator, pneumatic actuator, a hydraulic actuator, or a combination thereof.

12. The tool trap system of claim 10, wherein the cylinder comprises rack teeth configured to engage the gear, wherein the movement of the cylinder enables the rack teeth to engage the gear to rotate the lever.

13. The tool trap system of claim 10, comprising a second actuator configured to bias the cylinder in a second direction opposite the first direction.

14. The tool trap system of claim 13, wherein the second actuator comprises a mechanical spring, an air spring, or a combination thereof.

15. A tool trap system, comprising:

a first shaft configured to rotate in a housing;

a second shaft configured to rotate in the housing;

a first flapper coupled to the first shaft;

a second flapper coupled to the second shaft, wherein the first flapper and the second flapper are configured to rotate respectively with the first shaft and the second shaft between an open position and a closed position to control movement of a wireline tool through the housing;

an actuation system coupled to the first shaft and the second shaft, the actuation system configured to rotate the first shaft and the second shaft, the actuation system comprising:

a first lever coupled to the first shaft, wherein the first lever is configured to rotate the first shaft;

a second lever coupled to the second shaft, wherein the second lever is configured to rotate the second shaft;

a cylinder configured to couple to the first lever and to the second lever, wherein the cylinder is configured to move axially along a longitudinal axis of the cylinder to rotate the first lever and the second lever;

a first actuator coupled to the cylinder and configured to axially move the cylinder in a first direction; and a piston rod that extends through the cylinder and remains fixed during operation of the actuation system.

16. The tool trap system of claim 15, wherein the first actuator comprises an electric actuator, pneumatic actuator, a hydraulic actuator, or a combination thereof.

17. The tool trap system of claim 15, wherein the cylinder defines a first surface configured to contact and rotate the first lever and a second surface configured to contact and rotate the second lever.

* * * * *